US006395136B1

(12) United States Patent
Andersson et al.

(10) Patent No.: US 6,395,136 B1
(45) **Date of Patent: *May 28, 2002**

(54) PRESS FOR IMPRINTING AND DRYING A FIBROUS WEB

(75) Inventors: A. Ingmar Andersson, Hammarö ; A. Malin K. Kilian, Karlstad; Bertil Andrén, Molkom, all of (SE)

(73) Assignee: Valmet-Karlstad Aktiebolag, Karlstad (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/595,659

(22) Filed: Jun. 16, 2000

Related U.S. Application Data

(60) Provisional application No. 60/141,595, filed on Jun. 30, 1999.

(30) Foreign Application Priority Data

Jun. 17, 1999 (SE) ..... 9902318

(51) Int. Cl.[7] ..... D21F 3/02

(52) U.S. Cl. ..... 162/358.5; 162/288; 100/327

(58) Field of Search ..... 162/109, 111, 162/112, 113, 117, 204, 205, 206, 358.3, 358.4, 358.5, 359.1, 288, 362; 100/153, 154, 118, 35, 38, 327, 330; 492/48, 59; 264/280, 282, 284; 34/116, 118, 124

(56) References Cited

U.S. PATENT DOCUMENTS

| | | | | | |
|---|---|---|---|---|---|
| 3,753,276 | A | * | 8/1973 | Reisch | 29/129.5 |
| 3,806,406 | A | | 4/1974 | Ely | 162/206 |
| 4,211,743 | A | * | 7/1980 | Nauta et al. | 264/284 |
| 4,309,246 | A | | 1/1982 | Hulit et al. | 162/113 |
| 4,324,613 | A | | 4/1982 | Wahren | 162/111 |
| 4,738,752 | A | | 4/1988 | Busker et al. | 162/358.5 |
| 5,082,533 | A | * | 1/1992 | Pulkowski | 162/359 |
| 5,126,015 | A | * | 6/1992 | Pounder | 162/206 |
| 5,198,123 | A | * | 3/1993 | Stover et al. | 210/791 |
| 5,556,511 | A | | 9/1996 | Bluhm et al. | 162/206 |
| 5,701,682 | A | | 12/1997 | Chuang et al. | 34/115 |
| 5,776,307 | A | | 7/1998 | Ampulski et al. | 162/117 |
| 5,871,615 | A | * | 2/1999 | Harris | 162/140 |
| 6,012,234 | A | * | 1/2000 | Schiel | 34/119 |
| 6,036,909 | A | * | 3/2000 | Baum | 264/280 |
| 6,103,062 | A | * | 8/2000 | Ampulski | 162/109 |
| 6,106,447 | A | * | 8/2000 | Schiel | 492/48 |

FOREIGN PATENT DOCUMENTS

| | | | | |
|---|---|---|---|---|
| GB | 2 349 897 A | | 11/2000 | D21F/3/08 |
| JP | 411081177 | * | 3/1999 | D21F/1/46 |
| WO | 00/70145 A1 | | 11/2000 | D12F/11/00 |

* cited by examiner

*Primary Examiner*—Peter Chin
*Assistant Examiner*—Eric Hug
(74) *Attorney, Agent, or Firm*—Alston & Bird LLP

(57) ABSTRACT

A press for imprinting and drying a fibrous web includes a press device and a roll body, and a heat transferring device that heats the web in the press nip in the form of a sleeve that encircles the roll body and is heated by at least one heating apparatus. The external mantle surface of the sleeve that presses against the web has imprinting elements for imparting a desired imprinted pattern in the web. The sleeve can be substantially rigid such that it is stable in form and does not substantially deform under the loads imposed on it by the press device and roll body. Alternatively, the sleeve can be a flexible and deformable sleeve. The connection between the roll body and the sleeve is such that the sleeve can freely expand and contract axially and radially relative to the roll body as the sleeve is heated by the heating apparatus. The sleeve can be either permeable or impermeable. The imprinting elements can have various forms, including recesses and/or grooves formed in the mantle surface and/or through holes formed through the thickness of the sleeve.

27 Claims, 8 Drawing Sheets

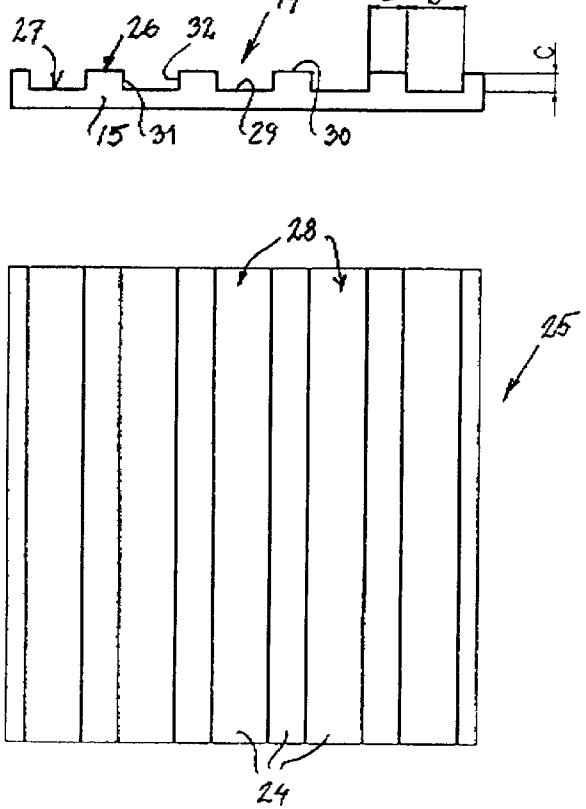
Fig. 5a
Fig. 5
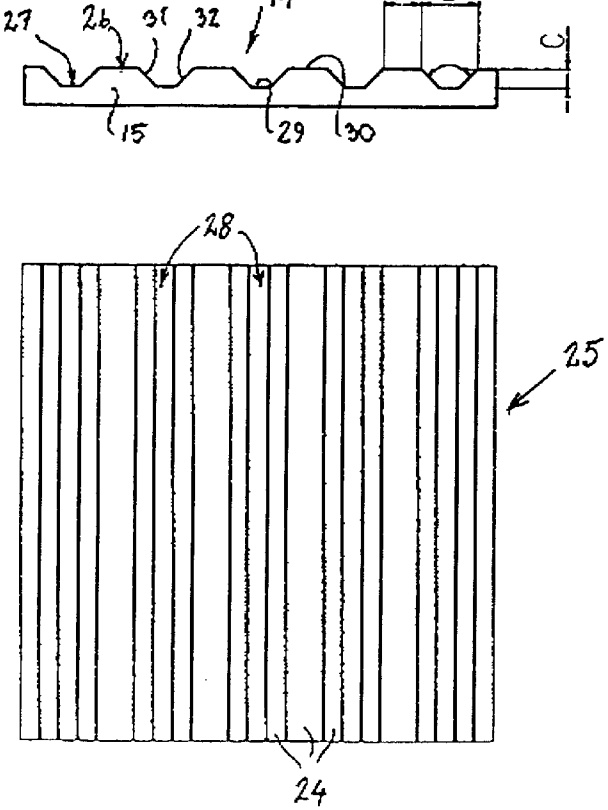
Fig. 4a
Fig. 4

PRESS FOR IMPRINTING AND DRYING A FIBROUS WEB

CROSS-REFERENCE TO RELATED APPLICATIONS

The present application claims the benefit of U.S. Provisional Patent Application No. 60/141,595 filed Jun. 30, 1999, and Swedish Patent Application SE 9902318-6 filed Jun. 17, 1999.

FIELD OF THE INVENTION

The present invention relates to a press for increasing the dry solids content of a continuous web of fibrous material such as paper, and for imprinting the web with an imprinted pattern.

BACKGROUND OF THE INVENTION

Pressing a wet fibrous web in a press at an elevated temperature and at a high pressure has been found to result in a substantially increased dewatering rate as well as other favorable effects. The technique, which is variously called an impulse technique, impulse pressing, or impulse drying, is described in U.S. Pat. No. 4,324,613. The maximum pressures employed in the method described in the '613 patent lie within the range of 3–8 MPa. The '613 patent describes a conventional roll press formed by two cylindrical press rolls. A burner supplies heat to one of the rolls. The heat is supplied to the mantle surface of the roll immediately before the press nip. The patent states that the roll can have a surface layer with low capacity of heat transmission so that the surface layer thereby can maintain a high temperature.

The roll surface temperatures are between about 150° C. and about 350° C. However, because the press nip is short in length, the dwell time for the paper web in this type of press nip is only a few milliseconds, and this dwell time is too short for it to derive much of the potential advantage of pressing at high temperature under simultaneously applied high pressure. Therefore, it has also been proposed to utilize impulse drying in a heated shoe press, wherein the press nip is extended to approximately 20 to 30 cm in length, so that the dwell time for the heat treatment becomes considerably longer.

Regardless of whether accomplished in a roll nip or an extended press nip, however, impulse drying in a heated press nip generally involves subjecting the web to high temperature and high pressure simultaneously in order to give very high thermal flows to the web. A heat transferring member in the form of the mantle surface of a steel or cast iron roll, which transfers heat to the fibrous web, achieves high heat transfer rates within the range of about 2–8 $MW/m^2$, which results in very high dewatering rates. The mechanism by which these high dewatering rates are achieved is not yet entirely clear. One theory that has been submitted is that when the vapor that develops near the surface of the heat transferring member closest to the fibrous web expands, the vapor helps to force substantially all remaining water in the fibrous web into the felt that is in contact with the fibrous web. Another theory is that the high dewatering rate is achieved by a combination of the reduced viscosity of the water caused by the high temperature, which makes it easier to force the water from the web, and a rapid evaporation of water from the web that occurs when the water heated to above 100° C. under pressure in the nip suddenly drops to atmospheric pressure when the web leaves the press nip.

U.S. Pat. No. 4,738,752 describes an extended, heated press nip in which the fibrous web encounters a hot surface defined by a rotatable press roll or by a metal belt that runs in a loop around a plurality of guide rolls. The press roll or belt is heated by a heating apparatus. The press roll can be formed to have an inner or first layer and an outer or second layer coaxially surrounding the first layer and having a coefficient of thermal conductivity that is larger than that of the first layer. The first layer may be of ceramics, while the second, external layer consists of metal and has a thickness of 0.0127–1.27 cm. The layers are in intimate contact with each other and together they constitute a unitary roll body.

When a roll of the above-described type is heated from the outside, one problem is that the external layer will become warmer than the layer or the layers located inward of the external layer. The external layer will therefore expand more than the inner layer and, because the external layer is joined with the inner layer, tensions will occur between the two layers. Even if the roll is homogeneous, differences in expansion and tensions between radially outer and radially inner portions of the roll will arise. In order to reduce the risk for damage of the roll caused by such difference in tensions, the initial heating of the roll must be done slowly. Another problem is that it is difficult to maintain the desired geometrical shape of the roll in the cross-machine direction because of the difficulties in maintaining the same temperature along the mantle surface of the roll and on the roll heads. Since the mantle surface and the heads cannot expand freely and independently of each other, large stresses occur between them and the mantle surface can become curved outwards or inwards in the cross-machine direction. Moreover, because the inner layer or portion of the roll will absorb some of the heat energy supplied for heating the outer layer or portion of the roll, the heating costs become high.

One disadvantage of using a metal belt as a heat-transferring device is that it must be arranged in a loop about at least two rolls, and hence this configuration requires considerable space. In order to clean the surface of the belt with a doctor blade, a counter roll must be arranged inside of the belt loop opposite the doctor blade. Another disadvantage is that the belt usually cannot be coated with layers in order to achieve certain properties of release and certain thermal conductivities.

In production of soft paper of relatively low basis weight, which for instance is used for making household paper, paper towels, and other hygiene products, it is generally desired to produce a bulk, i.e., a relationship between the volume and the weight of the paper, that is substantially higher than for other papers, as paper with high bulk has a desirable combination of softness and high power of absorption. In conventional production of paper, a coherent fibrous web is formed on a wire by dewatering a pulp suspension with initially very high water content. The moist web runs through a press section comprising one or more presses, each with at least one press nip, in which additional water is pressed out of the web. However, in a conventional wet press a certain re-wetting of the web inevitably occurs at the outlet of the press nip, and moreover the fibers are pressed together in a disadvantageous way such that a relatively flat and compact soft paper web with lower bulk than desired is obtained after the web has been dried in a drying section. In the manufacturing of paper, board, and cardboard, usually the drying section for drying the web has a large number of alternating drying cylinders and guide rolls around which the moist web runs. This large number of cylinders and rolls gives the paper machine a disadvantageous length.

In the manufacture of soft paper, usually a Yankee dryer has hitherto been used for the main drying of the web. The conditions at an Yankee dryer differ from those at a conventional wet press, in that the dewatering of the web is not accomplished primarily by pressing but rather is achieved chiefly by thermal drying of the web.

However, certain attempts have been made to manufacture soft paper with a bulk that is substantially increased from what is generally achievable using the conventional pressing and drying processes. For instance, U.S. Pat. No. 3,806,406 describes a procedure and a device for forming a high bulk soft paper web in which the wet web is transported on a felt through a press nip between a press roll and a heated Yankee dryer. Since compressing a fibrous web results in a lower bulk than what is desired for soft paper, the technique described in the '406 patent aims to reduce the surfaces of the fibrous web that are exposed to pressure in the press. Accordingly, the Yankee dryer has a mantle surface with alternately raised and lowered surface portions, which constitute a relief pattern for placing against the web. Thus, only the parts of the web that are in contact with the raised surface portions are compressed in the press nip, while the parts in between are left relatively unaffected. Substantially the entire drying of the web is done thermally by supplying heat from the heated Yankee dryer, while the soft paper web is maintained in a fixed position relative to the raised and lowered surface portions. If required, a certain pre-drying or after-drying of the web can be done as well by through-air drying. The web processed in this manner obtains a certain imprinted pattern that consists of compressed and non-compressed portions corresponding to the pattern of the mantle surface. Pattern imprinting of a moist fibrous web and drying of the imprinted fibrous web without destroying the procured structure gives a high bulk and, furthermore, the structure remains even if the dried fibrous web subsequently becomes wet.

However, the Yankee dryer has some disadvantages. It has a large diameter, and hence it is very bulky. In using a Yankee dryer, it is hard to achieve the very high temperatures that are generally desired in impulse drying because the Yankee dryer is heated from its interior by steam, and even though the steam inside the drum may have a high temperature, the external mantle surface of the drum reaches only approximately 95° C.–100° C. Moreover, the entire Yankee dryer must be heated up, with high energy costs as a consequence. Because of the relatively low temperature achieved at the outer surface of the Yankee dryer, the web must be in contact with the Yankee dryer for a long time period, which in turn leads to the need for a large diameter, and/or to a need for either pre-drying or after-drying, and occasionally both. Additionally, the aforementioned problem of internal tensions that can arise as a result of differences in temperature between different parts of a heated roll also can occur with the heated Yankee dryer.

SUMMARY OF THE INVENTION

The present invention seeks to overcome the drawbacks noted above, by providing a press for imprinting and drying a fibrous web wherein the press nip is defined between a press device and a roll body, and the heat transferring device that heats the web in the press nip is in the form of a sleeve that encircles the roll body and is heated by at least one heating apparatus. The sleeve is in driven engagement with the roll body such that rotation of the roll body causes the sleeve to pass through the nip with the web against an external mantle surface of the sleeve, the roll body and sleeve thus collectively comprising a counter roll. The external mantle surface of the sleeve that presses against the web has imprinting elements for imparting a desired imprinted pattern in the web. The sleeve can be substantially rigid such that it is stable in form and does not substantially deform under the loads imposed on it by the press device and roll body. Alternatively, the sleeve can be a flexible and deformable sleeve. During operation when the sleeve is heated to the desired operating temperature, the sleeve preferably loosely surrounds the roll body so that the sleeve can freely expand and contract relative to the roll body. Furthermore, there preferably is no attachment, adhesion, or other fixing connection between the roll body and the sleeve that would prevent such free expansion of the sleeve. Accordingly, the invention avoids the large thermally induced stresses that could occur between outer and inner layers or portions of prior unitary roll bodies.

The sleeve can be either permeable or impermeable. The imprinting elements can have various forms, including recesses and/or grooves formed in the mantle surface partially through the thickness of the sleeve and/or through holes formed entirely through the thickness of the sleeve.

The web is preferably arranged to contact and be carried by the mantle surface of the sleeve over an angular sector of the sleeve having an angular extent of about 10° to about 300°. The heating apparatus preferably is located ahead of the press nip by an angular spacing in the range of about 30° to about 330° as measured circumferentially about the sleeve.

The press call comprise either a roll press in which the press device in nipping engagement with the counter roll is a cylindrical roll, or an extended-nip press in which the press device comprises a press shoe having a concave surface and a flexible jacket that surrounds the press shoe and passes through the nip in sliding contact with the concave surface of the shoe. The endless clothing that passes through the press nip can comprise a belt having recesses therein for receiving water in liquid and vapor form from the web and transporting the water away from the web and out of the press nip, and for imparting an imprinted pattern to the web.

BRIEF DESCRIPTION OF THE DRAWINGS

The above and other objects, features, and advantages of the invention will become more apparent from the following description of certain preferred embodiments thereof, when taken in conjunction with the accompanying drawings in which:

FIG. 4 is an enlarged plan view of an imprinting pattern according to a first embodiment of the invention.

FIG. 4*a* is a cross-sectional view of the sleeve having the imprinting pattern of FIG. 4.

FIG. 5 is an enlarged plan view of an imprinting pattern according to a second embodiment of the invention.

FIG. 5*a* is a cross-sectional view of the sleeve having the imprinting pattern of FIG. 5.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
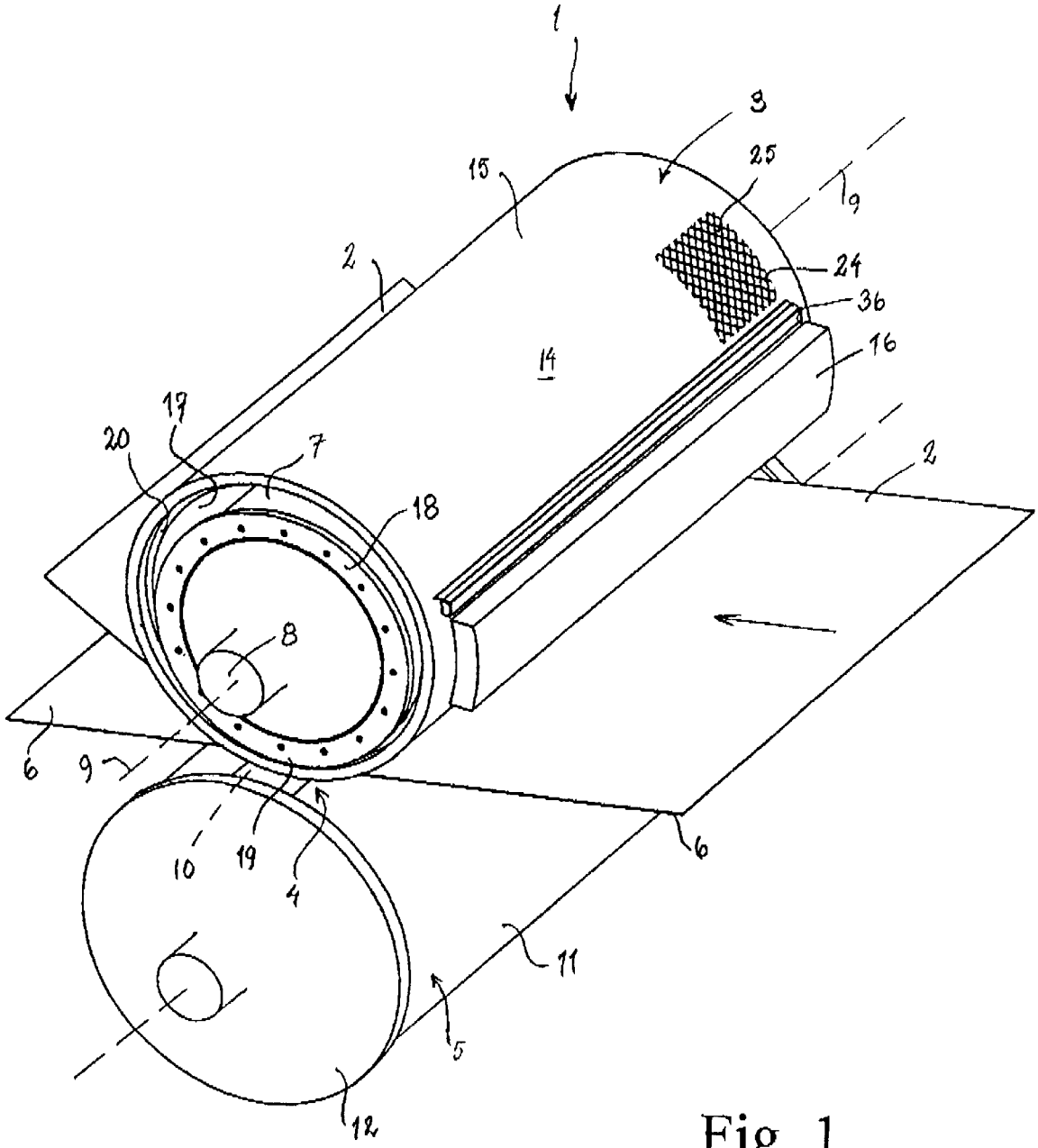
FIG. 1 is a perspective view of parts of a press including a counter roll and a shoe press roll, wherein the counter roll is formed of a rigid sleeve loosely encircling a cylindrical roll body, part of an imprinting pattern being shown on the external mantle surface of the sleeve.
Figure 2:
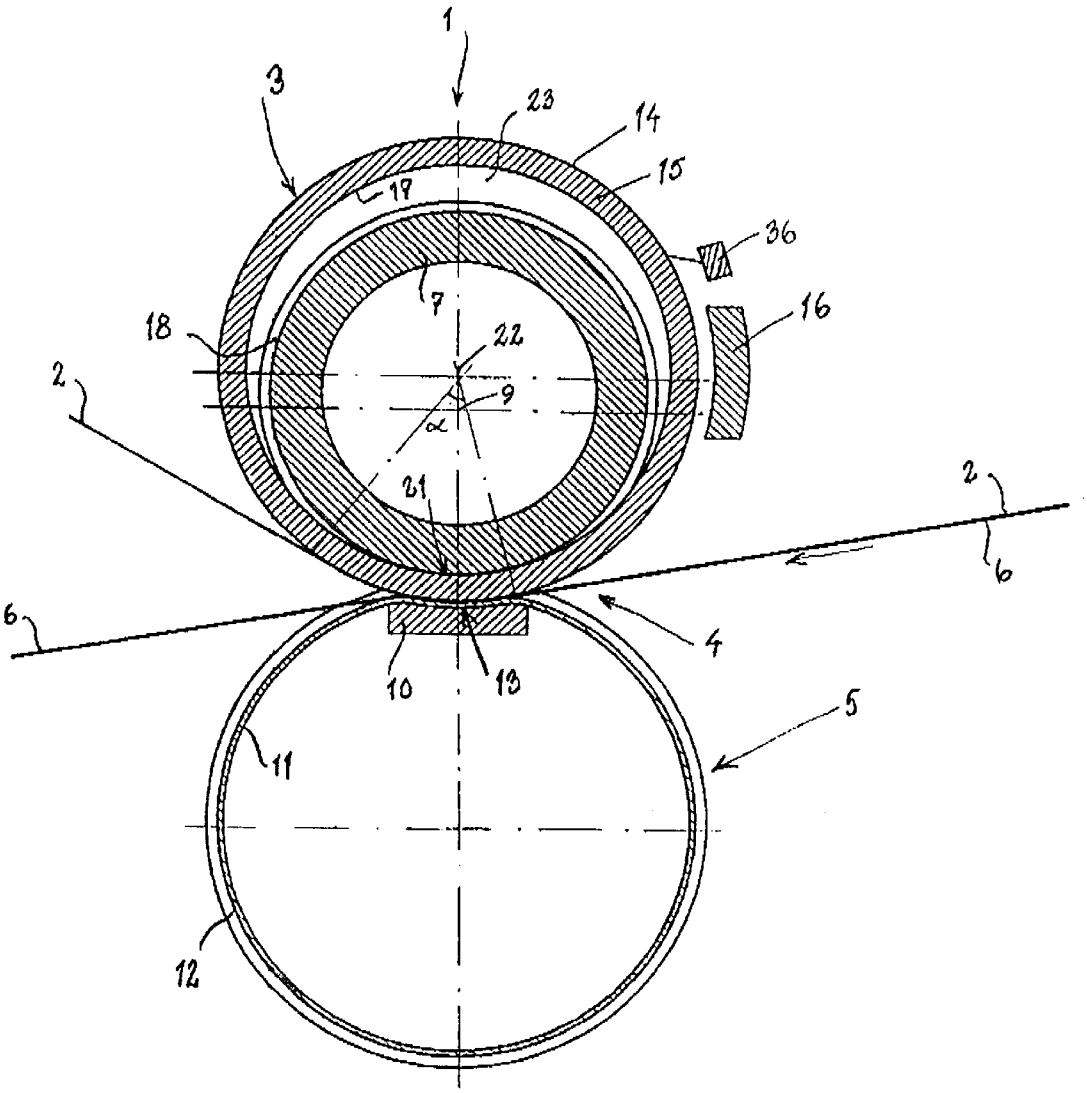
FIG. 2 is a cross sectional view of the shoe press according to FIG. 1 taken on a plane normal to the cross-machine direction.
Figure 3:
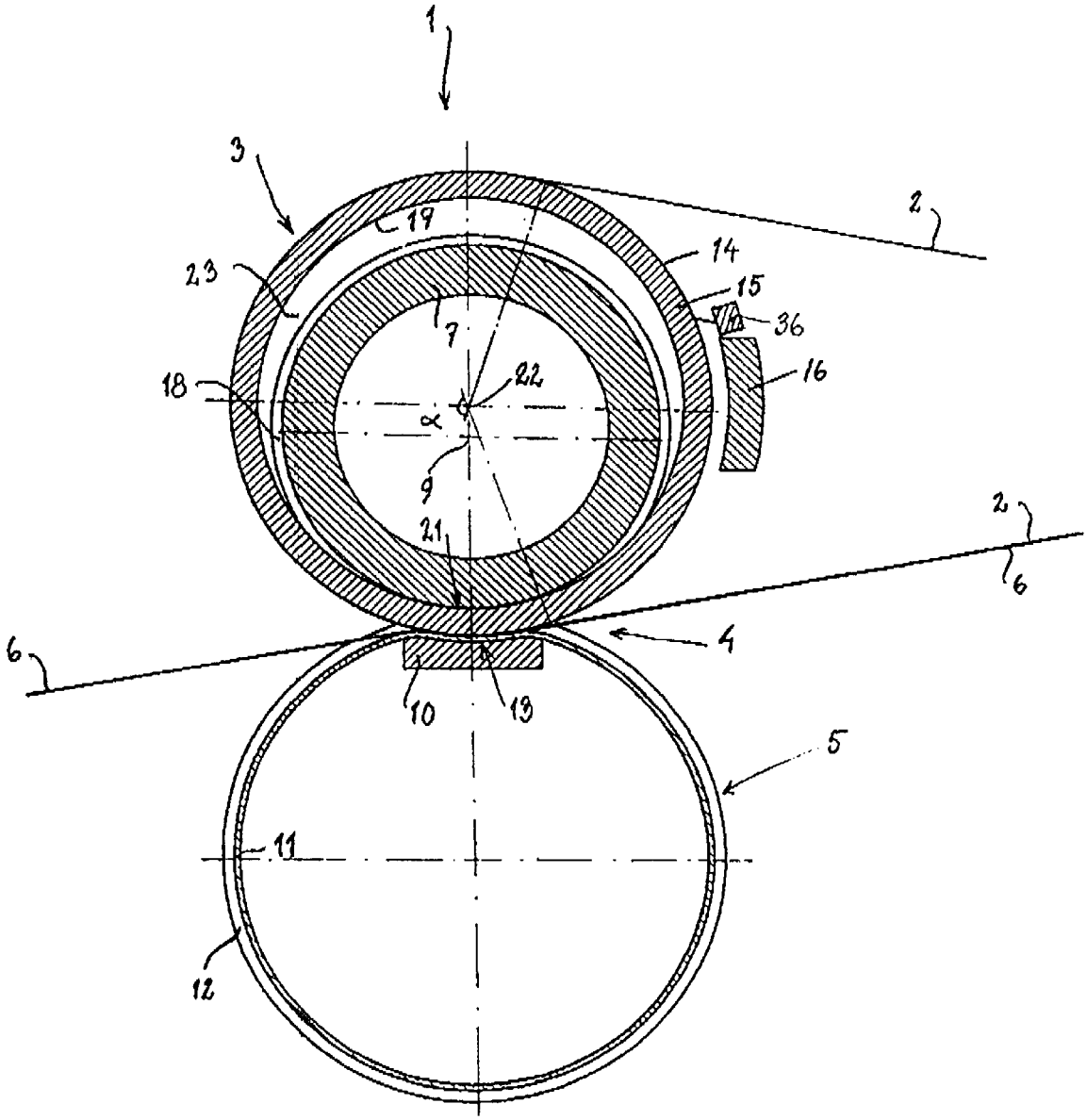
FIG. 3 is a cross-sectional view similar to that of FIG. 2, but showing an alternative embodiment in which the web is arranged to contact a longer sector of the sleeve downstream the press nip.

FIGS. 1 and 2 schematically depict parts of a press 1, which is part of a press section in a machine for the production of a continuous web 2 of cellulosic fibrous material. The invention is particularly but not exclusively applicable to paper machines for the production of paper with low basis weight, i.e., soft paper such as tissue or the like. However, the paper machine can be designed for the production of any other paper grade. The press 1 comprises a rotatably journalled counter roll 3, a cooperating press device 5 for forming a press nip 4 with the counter roll, and a clothing 6 that is in direct contact with the fibrous web 2 and preferably has the ability to receive liquid in liquid and gaseous state from the web 2 and to carry it out of the press nip 4. The counter roll 3 comprises a rugged cylindrical roll body 7 that has stub shafts 8, see FIG. 1, for rotatable journalling of the counter roll 3 in bearing houses (not shown). The roll body 7 is arranged rotatably around an axis of rotation 9 and has a mantle surface with a circular cross-section. In the illustrated embodiment, the press 1 is a shoe press with an extended press nip 4, the press device 5 comprising a shoe press roll. Thus, the press device comprises a press shoe 10 and an impermeable flexible jacket 11 that is fixed at rotatable peripheral roll head parts 12. The press shoe 10 has a concave surface 13, as shown in FIGS. 2 and 3, for generating pressure under cooperation with the convex roll body 7 of the counter roll 3 and for achieving the extended press nip 4. The jacket 11 runs through the press nip 4 in sliding contact with the concave surface 13 of the press shoe 10. Alternatively, the flexible jacket 11 may run in a loop around a plurality of rolls (not shown) and about the press shoe 10.

The clothing 6 of the shoe press 1 is arranged to run in an endless loop around a plurality of guide rolls (not shown) and through the extended press nip 4. The fibrous web 2 is supported on the clothing 6 up to the press nip 4 and is then separated from the clothing 6 after exiting the press nip 4, and downstream of the press nip the web is carried by the counter roll 3 around a predetermined section of the mantle surface 14 of the counter roll 3. Alternatively, the web can run in an open draw before the press nip, i.e., unsupported by the clothing. The web may also be separated from the counter roll 3 directly after the press nip 4, so that the web runs entirely free from any support.

In FIGS. 2 and 3 there are shown two alternative runs for the fibrous web 2 after the press nip 4. In the embodiment shown in FIG. 2, the fibrous web 2 is arranged to contact only a small angular sector of the mantle surface 14 of the counter roll 3. In the embodiment shown in FIG. 3, the fibrous web 2 is wrapped around the mantle surface 14 of the counter roll 3 over a substantially longer angular sector than in the embodiment shown in FIG. 2. By arranging the fibrous web 2 to contact a greater proportion of the mantle surface, more heat can be transferred to the web, and therefore a higher dry solids content can be achieved in the web. The surface section over which the fibrous web 2 is arranged to follow, including the nip length, has a length in the direction of rotation determined by the sector angle $\alpha$, see FIGS. 2 and 3, which preferably is within the range of about 10° to about 300° depending on the amount of after-drying that is needed in order to achieve the desired dry solids content.

The clothing 6 usually consists of a press felt, but a permeable process belt that has through openings and possibly recesses located between these can also be used, or an impermeable belt with recesses of suitable depth, shape, and orientation can be used. The recesses exist on the side of the clothing that faces the fibrous web 2. The openings and/or recesses are arranged to receive and transfer liquid from the fibrous web 2 out of the press nip 4. The openings and/or recesses also give the web 2 an impression in the form of an imprinted pattern, which imprint increases the bulk of the web 2. Instead of a permeable or impermeable belt, an open wire or a closed wire that has a sealing layer on its side that faces away from the web 2 can be used. The illustrated shoe press 1 having an extended nip is the preferred embodiment, but the invention is not limited to extended-nip presses and also encompasses other types of press devices such as roll presses in which the press device 5 is a cylindrical roll rather than a shoe roll.

The press 1 also includes a movable heat transferring device 15 that passes through the press nip along with the web for continuous transfer of heat to the web, and a heating apparatus 16 for heating the heat transferring device 15 to the desired operating temperature at startup and then for a continual or continuous heating during operation in order to maintain this operating temperature. The heating apparatus 16, which can be fixed or movable, e.g., oscillating, is arranged at a predetermined location or within a predetermined interval upstream of the press nip 4 in order to heat the circumference of the heat transferring device 15. Any suitable heating apparatus 16 may be used, although an induction heater presently is preferred. Examples of other heating apparatus 16 are electric heaters, infrared heaters, laser heaters, and gas burners. Preferably, the heating apparatus 16 is located ahead of the inlet of the press nip 4 by an angular displacement as measured circumferentially about the counter roll 3 of about 30° to about 330°. It may be advantageous to locate the heating apparatus near the outlet of the press nip 4 for more-efficient utilization of the space around the counter roll 3, which is possible because the heat loss from the heat transferring device 15 before the contact with the moist web 2 is comparatively small.

According to the invention, the counter roll 3 comprises a heatable sleeve that forms the heat transferring device 15.

The sleeve 15 encloses at least the entire axial extent of the cylindrical roll body 7 active in the press nip 4 and is so arranged that it can expand freely in relation to the roll body 7 upon heating without causing unfavorable stresses in the sleeve 15. The sleeve 15 has an interior surface 17 arranged to be brought in contact with the roll body 7 within the zone of the press nip 4, and an exterior surface that defines the mantle surface 14 of the counter roll around which the fibrous web 2 runs. The sleeve 15 is free from mechanical, adhesive or any other permanent, fixing connection with the roll body 7 that would prevent a free expansion of the sleeve 15 in the axial and/or radial direction in relation to the cylindrical roll body 7 outside the press nip 4, which occurs upon heating of the sleeve. Any such fixing connections between the sleeve and roll body would give rise to unfavorable stresses in the sleeve 15.

Flat annular rings 18 are coaxially mounted at the end surfaces of the cylindrical roll body 7, which rings 18 have a somewhat larger outer diameter than the cylindrical roll body 7 to form axial end stops 19 for the sleeve 15 during the passage of the sleeve 15 through the press nip 4. In the embodiment shown, the rings 18 constitute annular flanges (see FIG. 1), one of which is arranged to run in a groove 20 that is formed in the inside surface 17 of the sleeve 15, parallel with the end face of the sleeve 15. Even during operation when the sleeve 15 undergoes thermal expansion in the axial direction, the sleeve preferably is free from contact with one of or both of these end stops 19 in order to avoid axial compressive stresses in the sleeve 15 in the zone of the press nip 4, so that the straightness of the cylindrical mantle surface 14 in the cross-machine direction can be ensured.

Consequently, the sleeve 15 is completely free from permanent locking connections in all directions in order to allow the sleeve 15 to expand axially as well as radially in a stress-free manner in relation to the cylindrical roll body 7 during heating. During operation, the roll body 7 is arranged to press and hold the sleeve 15 at a region of contact 21 within the zone of the press nip 4 at the press shoe 10 for generating pressure in cooperation with the roll body 7 so as to create a friction force in the region of contact 21 between the roll body 7 and the sleeve 15 large enough to ensure that the sleeve 15 will be rotated by the roll body 7 and at the same speed at the region of contact 21 (see FIGS. 2 and 3).

Figure 8:
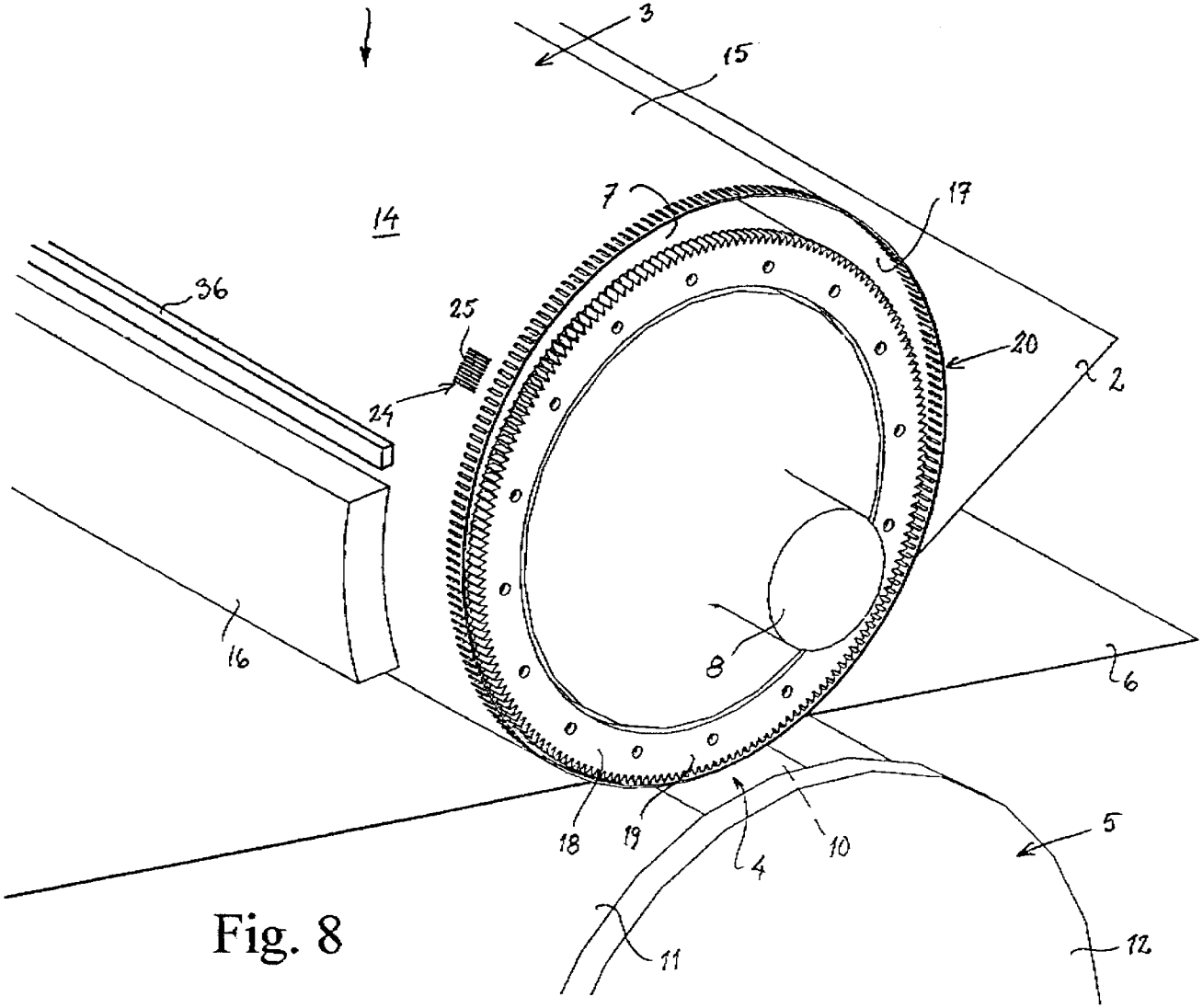
FIG. 8 is a perspective view of a press with a counter roll and a shoe press roll similar to the view shown in FIG. 1, but with the counter roll having a flexible sleeve according to another embodiment of the invention, part of an imprinting pattern being shown on the flexible sleeve.

The sleeve 15 may be a rigid sleeve that is stable in shape, (see especially FIGS. 1–3), or alternatively may be a flexible sleeve 15 that is not stable in shape (see especially FIG. 8).

In FIGS. 1–3 the sleeve 15 is schematically illustrated as a cylindrical, rigid sleeve 15 that is stable in shape and has an exterior surface 14 that constitutes a rigid mantle surface of the sleeve 15 and an interior surface 17 that has a constant circular cross-section. When the sleeve is heated to its desired operating temperature, the interior surface 17 has a larger diameter than the outer diameter of the cylindrical roll body 7, as shown in the drawings. However, the diameter of the rigid sleeve 15 is shown highly exaggerated in relation to the roll body 7. The rigid sleeve 15 shown in FIGS. 1–3 has a certain wall thickness measured between the inner surface 17 and the mantle surface 14, which wall thickness is generally constant in the lengthwise direction of the sleeve. The wall thickness of the sleeve 15 is selected depending upon the specific use with varying demands for the properties of the sleeve 15. In general, the wall thickness is optimized for heating the loose sleeve 15 as quickly as possible and for maintaining the straightness of the mantle surface 14 in the cross-machine direction. The wall thickness of the sleeve 15 is large enough to make the sleeve 15 substantially rigid and stable in shape, i.e., the sleeve is at least self-supporting so that when resting on a flat supporting surface it will maintain its circular shape. Preferably, the sleeve is so rigid and so stable in shape that it will not be considerably deformed by the usual stresses imposed on the sleeve during assembly and normal operation. The rigid sleeve 15 has a sufficient wall thickness in order to resist the large stresses in the press nip 4 that can arise from the differences in radius between the different construction elements.

During operation the rigid sleeve 15 is arranged to rotate around its own axis of rotation, i.e. its central axis 22, which is situated eccentrically in relation to the axis of rotation or central axis 9 of the roll body 7. The eccentricity, defined as the distance between the axes 9 and 22, equals half of the difference between the outer diameter of the roll body 7 and the inner diameter of the sleeve 15, i.e., the difference in radius lengths. When the press shoe 10 and the counter roll 3 are displaced vertically away from each other by a distance corresponding to this radius difference, the sleeve 15 will hang on the roll body 7 and its central axis 22 will be situated beneath the central axis 9 of the roll body 7. In this condition the sleeve 15 is entirely loose in relation to the roll body 7, which enables a simplified change of the sleeve 15 in that a space is created between the press device 5 and the roll body 7 through which the sleeve 15 can be removed axially.

It is possible to size the inner diameter of the sleeve 15 in relation to the outer diameter of the roll body 7 such that at room temperature the sleeve forms a tight or interference fit about the roll body, yet when heated up to its operating temperature the sleeve expands sufficiently to become loose about the roll body. In this situation, removal of the sleeve must be performed while the sleeve is heated sufficiently to enable it to be slid axially off the roll body; similarly, installation of a new sleeve would require heating of the sleeve to expand it sufficiently to allow it to be slid axially onto the roll body.

The concave surface 13 of the press shoe 10 has a radius of curvature that generally corresponds to the radius of the rigid cylinder-shaped sleeve 15. The sleeve 15 has sufficient rigidity and stability that it will exert pressure on the web in the press nip by the action of the roll body 7. In other words, the pressure from the roll body 7, although acting over the region of contact 21 that is shorter in the direction of rotation than the length of the press nip 4, is propagated through the sleeve 15 over a greater length so that the length of the press nip 4 becomes about equal to the width of the press shoe 10. When a section of the rigid sleeve 15 passes the press shoe 10, a minor deformation of the section may occur as a result of the difference between the inner radius of the sleeve 15 and the outer radius of the roll body 7. This minor deformation, however, will disappear as soon as the pressure on the section of the sleeve is relieved after it exits the press nip 4, and the rigid sleeve 15 is thick enough to tolerate the deformation without harmful effect. Thus, it will be understood that references in the present specification to the sleeve being substantially rigid are not meant to imply that the sleeve does not deform under any circumstances, but rather that the sleeve substantially maintains its circular shape under the normal loads encountered during use.

During operation when the sleeve is heated to its operating temperature, the difference in diameter between the outer diameter of the roll body 7 and the inner diameter of the sleeve 15 is such that a free space 23 is formed on the opposite side of the roll body 7 from the press nip 4. Because of this free space 23 inside the sleeve 15, only minor heat quantities will be transferred from the heated sleeve to the roll body 7. During operation, this space 23 has the shape of a crescent. Only in the zone of the press nip 4 within the region of contact 21 does a transfer of heat from the sleeve 15 to the roll body 7 occur, but the amount of heat transfer is small in view of the relatively small contact surface. In general, the temperature on the hot mantle surface 14 of the sleeve 15 at the inlet to the press nip 4 may be within the range of about 150° C. to about 400° C.

Because the rigid cylinder-shaped sleeve 15 remains round during operation, a constant distance between the sleeve 15 and the heating apparatus 16 is maintained with constant operating temperature.

Generally, the wall thickness of the rigid sleeve 15 is 5–100 mm, and more preferably 15–40 mm. Preferably, at room temperature the sleeve fits closely or with an interference fit about the roll body, and when heated to its operating temperature the sleeve expands to have a greater inside diameter than the outside diameter of the roll body. The difference between the inside diameter of the rigid sleeve 15 and the outside diameter of the roll body 7 when the sleeve is heated during operation generally is 0.01–100 mm, and more preferably 0.5–10 mm. The less the wall thickness of the sleeve 15 is, the faster a high temperature is achieved at the mantle surface 14 because the total mass that must be heated is proportional to the wall thickness.

In the embodiment as shown in FIG. 8 in which the sleeve 15 is flexible, the sleeve will elastically deform when exposed to an external load, such as when a section of the sleeve passes through the press nip 4 and is pressed between the roll body 7 and the press device 5, but will substantially return to its original cross-sectional shape thereafter when the external load is released. Generally, the flexible sleeve 15 has a wall thickness within the range of about 0.4–5.0 mm, and more preferably about 0.8–2.3 mm. The difference between the internal circumference of the flexible sleeve 15 and the external circumference of the roll body 7 during operation in general is within the range of about 0–100π mm, and more preferably about 0.1–10π mm. Since the sleeve 15 is flexible, a cleaning doctor may be arranged at a suitable place so that the sleeve 15 will be deflected against the roll body 7, which will function as a counter member. Furthermore, the flexible sleeve 15 is free from any torque from frictional forces, and the sleeve handling is facilitated considerably by using the flexible embodiment of the sleeve 15.

The rigid or flexible sleeve 15 may be impermeable, or alternatively may be a permeable structure. Making the sleeve 15 permeable can facilitate the release of the fibrous web from the sleeve and can also simplify the cleaning of the sleeve. The permeable sleeve 15 may consist of a metallic fabric formed into a cylinder, which for instance may be of bronze. However, the permeable sleeve 15 can instead consist of any form of suitable permeable elements that can be formed into a cylinder, including plate-shaped elements attached to each other end-to-end to form a cylindrical shape. The elements can be provided with a pattern of elongated slots, openings, or holes 35 through the thickness of the elements. The elongated slots may be so arranged that by stretching each plate in its plane the slots expand to form a net of openings, for instance elliptical ones, after which the end parts of the plates are attached to each other by a welded joint.

Potential advantages of the permeable sleeve 15 include a reduction of the risk of delamination, especially for paper webs of medium and high basis weights, and reduction of the tendency of the web to stick to the mantle surface 14 of the sleeve 15. In addition, the releasing of the web from the sleeve may be facilitated, if desired, by the provision of spray nozzles (not shown) for blowing air directly or through the sleeve against the fibrous web at a position downstream of the web releasing point. Furthermore, with a permeable imprinted sleeve 15 it is normally easy to loosen the fibrous web 2 unharmed from the sleeve 15 and to clean remaining fibers from the sleeve 15. In order to facilitate the release of the web 2 from the mantle surface 14, air-knives (not shown) may be provided at suitable locations at the outlet from the press nip 4. However, the web 2 tends to be easily detached from the mantle surface 14 of the sleeve 15 at temperatures over 200° C.

If desired, the air jet may consist of or cooperate with hot gases from a gas burner or the like. Any fibers stuck to the sleeve will immediately be burnt to ashes and will be carried away by the jet of gas. Furthermore, the heating of the sleeve by the hot gases decreases the amount of heating of the sleeve that must be performed by the primary heating apparatus 16.

Although not illustrated in the drawings, the roll body 7, which is enclosed by the permeable sleeve 15, may have a first blow zone for directing air forcefully through the sleeve against the web to detach the web from the sleeve, and may have a second blow zone arranged downstream of the first blow zone in the direction of rotation of the sleeve for cleaning of the permeable sleeve. If desired, a suction zone may also be arranged at the nip of the impulse press for removing vapor and for reducing the risk of delamination of the web. For instance, the roll with at least one blow zone may have a suction zone situated in the press nip.

In accordance with the present invention, the sleeve 15 defines a plurality of imprinting elements 24 arranged on, in, and/or through the mantle surface 14 of the sleeve 15 (see FIGS. 1 and 8). The imprinting elements 24 are arranged in a predetermined pattern, preferably a relief pattern 25, for placing against the fibrous web 2 so that a pattern imprint is generated in the fibrous web 2 according to the imprinting elements 24 when the web 2 runs through the press nip 4 together with the clothing 6. The imprinting cause s positive and lasting changes in the properties of the web 2, among which are an increase in the bulk of the web 2 by about 50–150% compared to conventional pressing with a smooth counter roll.

The imprinting elements 24 (see FIGS. 4–7*a* and 9–10) are formed by recesses in the mantle surface 14 of the sleeve 15, which recesses preferably are arranged to constitute relatively raised and lowered surface portions 26, 27 (see FIGS. 4–7*a*). The imprinting elements 24 may be uniformly distributed. Alternatively, all, some, or one specific imprinting element 24 may be arranged separately or in groups at a desired spacing from one another so that together they constitute any other predetermined pattern 25, for instance in the form of structure, symbols, figures, or common d9cors such as grids, digits, letters, trademarks, names, or the like. All, some, or one specific imprinting element 24 may be of elliptical, circular, rectangular, square or other polygon shape, or may be of any another imaginable geometrical shape considered reasonable for obtaining the desired pattern 25 in the fibrous web 2 to be produced.

In the embodiment with raised or lowered surface portions 26, 27 (see FIGS. 4–7*a*), the raised surface portions 26, which are arranged between the lowered surface portions 27, may for instance have flat, multi-faceted, tapered, arched or other convex cross-sectional shapes or parts. Similarly, the lowered surface portions 27 may comprise flat, multi-faceted, curved, hollowed out, or other concave cross-sectional shapes or parts.

Instead of the surface portions 27, which are lowered only partially through the wall thickness of the sleeve 15, the imprinting elements 24 may comprise a great plurality of through openings or holes 35 formed in any suitable fashion through the wall of the sleeve 15 to form a desired permeable pattern 25 (see FIGS. 9 and 10), or a combination of both raised and lowered surface portions 26, 27 and through holes 35. The imprinting elements 24 are so arranged in size and number that the raised surface portions 26 that are in pressing contact with the fibrous web 2 collectively constitute a substantial fraction of the total mantle surface 14, preferably between about 20% and about 50% of the mantle surface 14.

Furthermore, the imprinting elements 24 may be arranged so that they form continuous grooves with even spacing across the mantle surface 14. As an alternative, the grooves may be grouped in a plurality of bands each comprising several continuous grooves relatively closely spaced from one another, with the bands being spaced apart by a relatively greater distance. As yet another alternative, the imprinting elements 24 may comprise intermittent and discrete groups of elements in the mantle surface 14, which imprinting elements 24 are arranged in lines that extend generally in the direction of rotation of the sleeve 15, at an angle to the direction of rotation of between 10° and 80° diagonally from one or both of the end surfaces of the sleeve 15 to one or both of the opposite end surfaces, or substantially across the direction of rotation. The grooves, bands of grooves, or groups may be straight or waved, e.g., sine or zigzag shaped, and the distance between them can vary. The spacing between two adjacent and mutually parallel grooves, bands, or groups may be from about 1 to 5 mm, while the grooves 28 may have a width between about 0.5 and 2.0 mm and a depth of about 0.1 to 2.0 mm. The imprinting elements 24 may be formed with the aid of mechanical, laser or chemical working of the mantle surface, for instance by milling, boring, turning, electrochemical pickling, or etching partway or all the way through the wall of the sleeve 15 from its outer mantle surface 14.

Seen in a cross-section of the sleeve 15, the difference in height, i.e., the difference in radius, between the raised and the lowered surface portions 26, 27 lies within the range of about 0.1–2.0 mm, while the width of the raised surface portions 26 suitably lies within the range of about 0.5–5 mm. At the passage of the web 2 through the press nip 4 substantially only the parts of the web that are in contact with the raised surface portions 26 will become compressed in the press nip 4, while the parts of the web in between are left relatively uncompressed.

In the FIGS. 4–7*a* and 9–10 described below, a number of different embodiments of patterns 25 for the mantle surface 14 of a rigid or flexible sleeve 15 are shown. In the embodiments shown in FIGS. 4–7 the sleeve 15 is impermeable, but as mentioned above it may also be designed as a permeable sleeve 15, for instance by fabricating it as a net or fabric structure, or by the arrangement of through holes 35 (see FIGS. 9 and 10). Consequently, the invention is in no way limited to the illustrated embodiments, but any other configuration of imprinting elements 24 for imprinting of predetermined patterns 25 in the fibrous web 2 according to what is mentioned above falls within the inventive concept.

In FIGS. 4 and 4*a* there is schematically shown, in top elevation view and crosssection, a detail of a pattern 25 according to a first embodiment, which pattern 25 comprises imprinting elements 24 in the form of a plurality of straight and mutually parallel grooves 28, which divide the mantle surface of the sleeve into elongated, alternately raised and lowered surface portions 26, 27. The surface portions 26, 27 in a cross-section through the sleeve have a flat bottom surface 29 and a flat top surface 30, respectively, between which wall surfaces 31, 32 extend divergently from the bottom surface 29 towards the top surface 30. The inside corners between the bottom surface 29 and the wall surfaces 31 and 32, and the outside corners between the top surface 30 and the wall surfaces 31 and 32, are shown in FIG. 4*a* as being sharp with no rounding or fillets, but they may instead be designed with a small radius for rounding the corners. In the cross-sectional view shown in FIG. 4*a,* the width and the difference in height of the two surface portions 26, 27 are illustrated with the markings a, b and c, which widths and differences in height are within the ranges mentioned above. The grooves 28 in the illustrated embodiment extend parallel to the end face of the sleeve in the direction of rotation of the sleeve around its entire circumference in endless rings, but in another embodiment (not shown) they may instead extend at a non-parallel angle to the end face of the sleeve.

In FIGS. 5 end 5*a* there is schematically shown, in top elevation view and cross-section, a detail of a pattern 25 according to another embodiment, which pattern 25 comprises imprinting elements 24 similar to the grooves 28 that are shown in the first embodiment, but which differ in that they have wall surfaces 31, 32 that are mutually parallel and extend perpendicularly between the bottom surface 29 and the top surface 30.

Figure 6A:
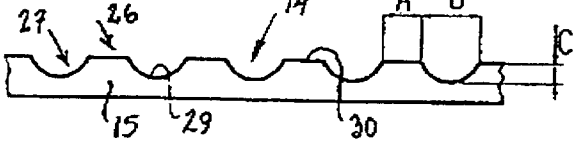
FIG. 6*a* is a cross-sectional view of the sleeve having the imprinting pattern of FIG. 6.
Figure 6:
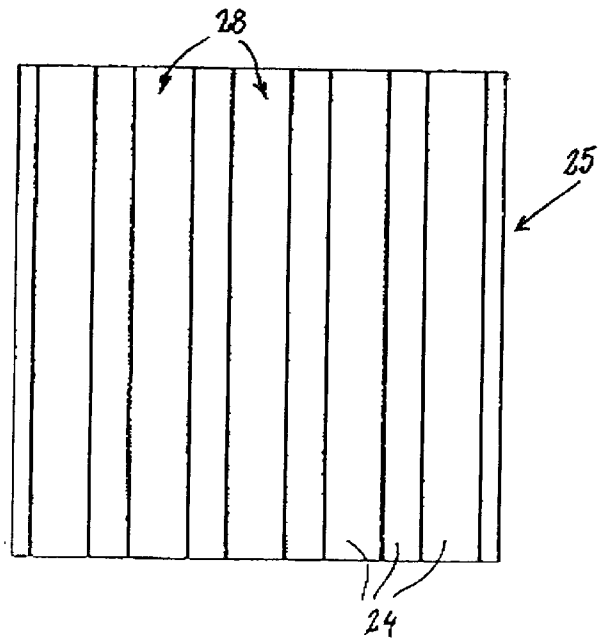
FIG. 6 is an enlarged plan view of an imprinting pattern according to a third embodiment of the invention.

In FIGS. 6 and 6*a* there is schematically shown, in top elevation view and cross-section, a detail of a pattern 25 according to another embodiment, which pattern 25 comprises imprinting elements 24 in the form of grooves 28 similar to the ones that are shown in the first and the second embodiments above, but which differs in having a non-planar bottom surface 29 (see FIG. 6*a*) and a flat top surface 30 at the raised the surface portions 26 thus formed between the grooves 28.

Figure 7A:
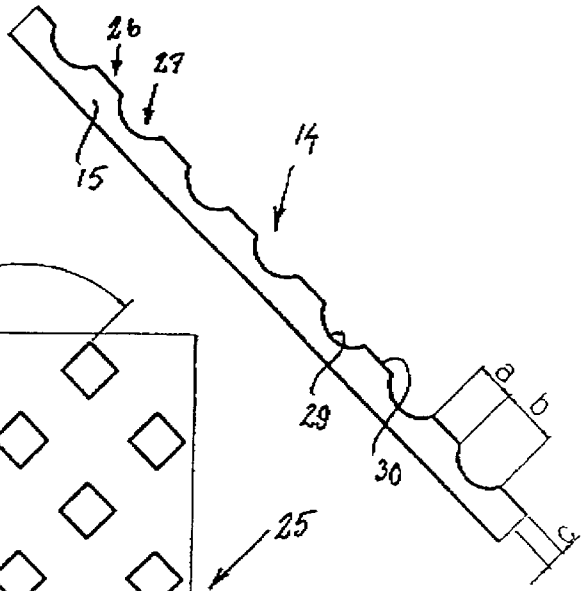
FIG. 7*a* is a cross-sectional view of the sleeve having the imprinting pattern of FIG. 7.
Figure 7:
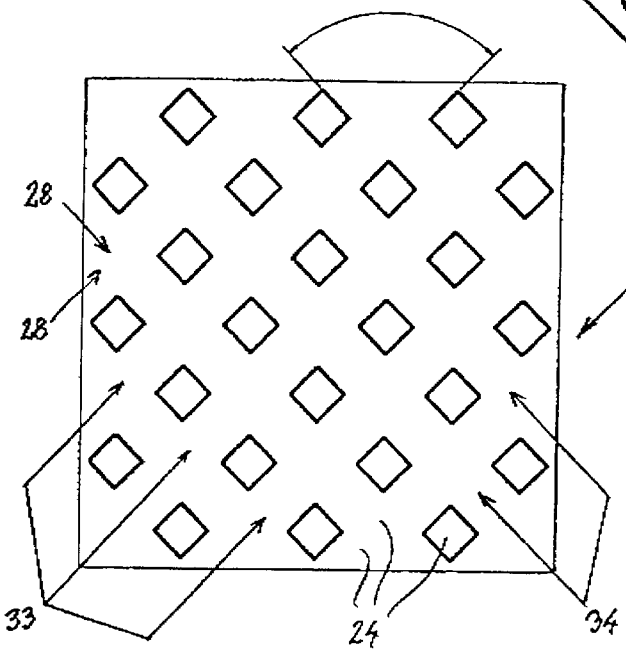
FIG. 7 is an enlarged plan view of an imprinting pattern according to a fourth embodiment of the invention.

In FIGS. 7 and 7*a* there is schematically shown, in top elevation view and cross-section, a detail of a pattern 25 according to another embodiment, which pattern 25 comprises imprinting elements 24 comprising first and second groups of grooves 33, 34 each of which comprises a plurality of grooves 28 that are mutually parallel within the respective group. The first group 33 extends from the first end surface to the second end surface of the sleeve, and the second group 34 extends from the second end surface of the sleeve to the first, and the two groups of grooves 33, 34 cross each other at an angle of between 10° and 170°. Both groups of grooves 33, 34 have a concave bottom surface 29. The two groups of grooves may also, in an unillustrated embodiment, have different angles relative to the sleeve end surfaces in order to avoid the same bands in the clothing being compressed turn after turn.

Figure 9:
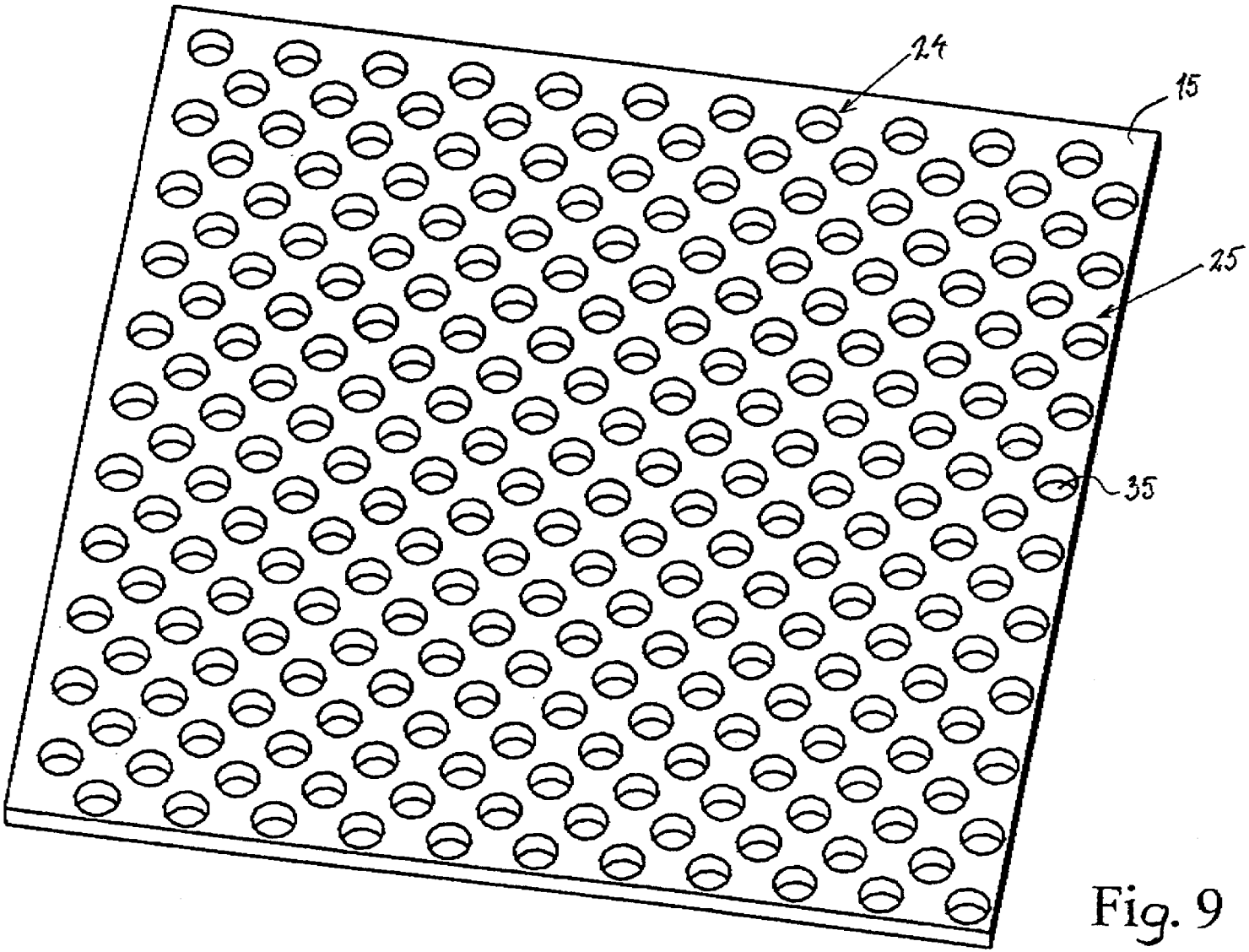
FIG. 9 is an enlarged perspective view of a portion of the flexible sleeve of the press of FIG. 8 showing one embodiment of an imprinting pattern according to the invention.

In FIG. 9 there is schematically shown in perspective view a detail according to a first embodiment of a through-going pattern 25 of a permeable sleeve 15, which pattern 25 comprises imprinting elements 24 comprising substantially circular and through-going holes 35 extending in the thickness direction of the sleeve 15. The holes are arranged at a predetermined mutual spacing, successively in line and preferably at an angle to the direction of rotation of the sleeve 15 diagonally from one end surface of the sleeve 15 to the other. The width of the holes 35, the angle relative to the end surfaces of the sleeve, the mutual spacing between the holes in the line, and the spacing between the lines lie within the ranges mentioned above.

Figure 10:
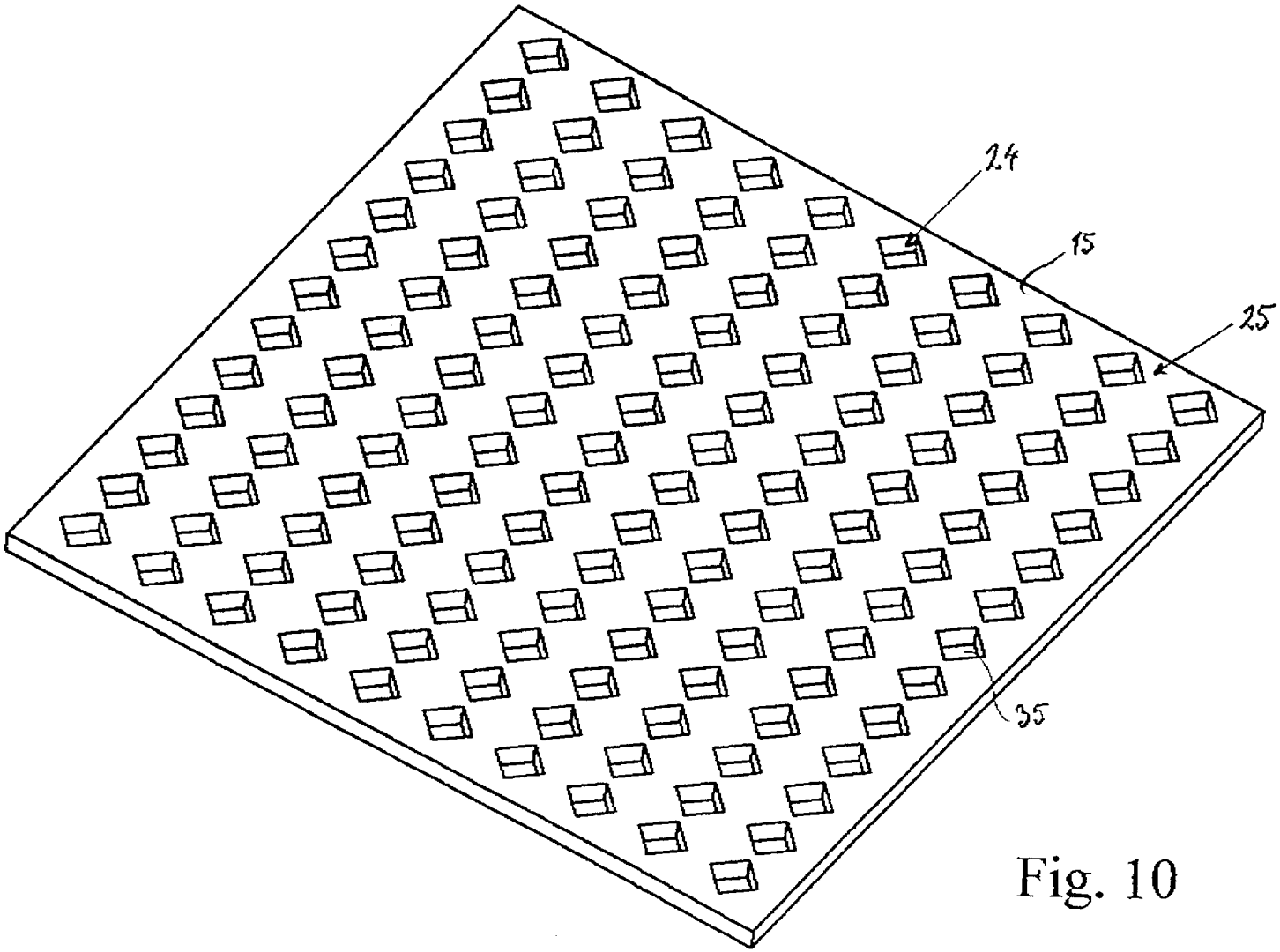
FIG. 10 is a view similar to FIG. 9, showing a further embodiment of an imprinting pattern according to the invention.

In FIG. 10 there is schematically shown in perspective view a detail according to a second embodiment of a pattern 25 of a permeable sleeve 15, which pattern 25 comprises imprinting elements 24 similar to the holes 35 that are shown in the first the embodiment, but which differ in that they have a rectangular shape.

The imprinted rigid or flexible sleeve 15 may be formed of a single homogeneous layer forming the entire thickness of the sleeve. Alternatively, the sleeve can comprise more than one layer of different materials. When the rigid sleeve 15 consists of several layers, one of the layers is a supporting layer with the primary function being to provide rigidity and stability to the sleeve. One or more surface layers can be joined to the supporting layer to provide the sleeve with desired surface properties such as a release ability and/or a desired capacity of heat transmission of the mantle surface 14. A particular capacity of heat transmission of the mantle surface 14 may be desirable in order to control the supply of heat to the fibrous web 2 and to prevent delamination of the web 2. Delamination is the phenomenon when the fibrous web 2 bursts upon exiting the press nip 4, because the steam pressure inside the web 2 is greater than what the bonding forces in the web 2 can withstand.

The cylindrical roll body 7 may be provided with a surface layer of one or several suitable materials on its mantle surface in order to increase the resistance to wear and/or increase the corrosion-resistance and/or to provide insulation of the roll body so that the heat being transferred from the sleeve to the cylindrical roll body 7 within the press nip 4 is reduced. Alternatively or additionally, the sleeve 15 may have such a surface layer (not shown) on its interior surface 17.

As suitable materials for a surface layer with the desired release ability and desired capacity of heat transmission, aluminum oxide, chromium oxide and zirconium oxide-based ceramics can be used. Suitable materials in order to increase the resistance to wear include carbides of tungsten and/or chrome, and chrome steel. Suitable materials in order to increase the corrosion resistance include alloys based on one or more of nickel, chrome, and cobalt. Suitable insulation materials include zirconium oxide-based ceramics. As materials for a homogeneous sleeve (i.e., consisting of a single layer of the same material), or for the supporting layer of a sleeve consisting of at least two layers, nodular-iron, cast steels, and weldable high-strength structural steels can suitably be used.

The roll body 7 of the press 1 may be a so-called solid press roll, appropriately modified according to the invention, or a deflection-compensated roll may alternatively be used. Since the contact surface between the hot sleeve 15 and the mantle body of the deflection-compensated roll is small, only a small amount of heat is transferred to the roll. Enough heat can be removed with the oil in the roll in order to attain a reasonable temperature and a high enough viscosity in the oil to achieve the desired function of the roll.

The temperature of the web 2 can be increased before the press nip 4 by arranging one or more steam boxes (not shown) in the felt loop and/or near the free side of the web 2. Preheating of the wet web 2 leads to a lower viscosity of the water, which facilitates pressing the water out of the fibrous web at the press nip 4. Additional drying devices may also be arranged. after the press nip 4, as for instance one or more through-air drying machines, for more high-grade drying of the web 2.

From the foregoing, it will be recognized that the invention facilitates a number of distinct advantages. In the embodiment with a loose, rigid sleeve 15, advantageously the mantle surface 14 may be coated to enhance the release properties, the heat transfer to the paper, and to reduce unwanted thermal flow radially inwards of the sleeve 15. By making the wall thickness of the rigid sleeve 15 large enough, the mantle surface 14 of the sleeve 15 in contact with the web 2 may be treated like a conventional press roll surface in order to be cleaned, when necessary, with a cleaning device 36 such as a doctor blade, with a metal brush, or by spray nozzles for air blowing. In the embodiment with a flexible sleeve 15, the sleeve is particularly easy to install and remove from the roll body. In the embodiment with a permeable sleeve 15, the risk of delamination of certain paper grades can be reduced by providing a suction zone at the counter roll for removal of the steam, and also a release of the web from the sleeve can be facilitated since through-blowing of air is possible, and cleaning of the sleeve is facilitated with the aid of a cleaning device 36 in the form of a burner for burning off adhered fibers. Furthermore, the handling of the sleeve is made easier.

A press section of a papermaking machine, in accordance with the present invention, can be provided with one or more presses 1 for impulse drying with press nips 4 arranged in succession. The press section is energy efficient in that the sleeve can be heated faster and with less energy than conventional rolls in view of the sleeve's reduced mass relative to conventional rolls. Furthermore, no problems with thermally induced stresses in the counter roll 3 occur, and hence the desired straightness of the counter roll in the cross-machine direction can be maintained.

Another advantage of the invention is that a fibrous web 2 that has been dried rapidly at a highly increased temperature in conjunction with imprinting of a structured pattern 25 in the wet), as done in accordance with the present invention, retains its structure after the drying even after absorption of liquid. Accordingly, the advantageous product characteristics achieved by the imprinting, such as high bulk, enhanced softness, favorable stretchability, and high liquid absorption, are maintained. In production of soft paper, a softer paper with more bulk is obtained by means of the imprinted sleeve 15.

Moreover, the invention enables a substantial reduction in the length of the drying section by providing fast drying in the impulse press 1 and the elimination of a long conventional drying section and/or a large Yankee dryer. Thus, high paper production rates and lower energy costs can be achieved.

When the imprinting elements 24 include through-going holes 35, outlets for the steam are created in the press nip 4. When the imprinting elements include recesses such as the described grooves, the recesses provide space for the steam to occupy. These outlets and/or spaces for the steam result in a reduction of the steam pressure and, hence, a reduction of the risk of delamination of the web 2, which is particularly beneficial in the production of papers other than soft paper, since unlike soft paper these types of paper generally do not have sufficient permeability to let the steam easily pass through. Additionally, the steam that penetrates through the web 2 is considered to give the web 2 more advantageous release properties against the sleeve 15. The total contact surface of the fibrous web 2 that is heated by the sleeve 15 increases substantially so that the drying is considerably faster, while the total contact surface that is exposed to pressure from the sleeve 15 in contrast is considerably reduced to about 20–50% of the total web surface 2 ahead of the press nip 4. In addition, the steam allows the soft paper web 2 to expand in the recesses of the pattern 25, so that a product is achieved that is structured and thereby fluffier, i.e., has more bulk. At the depression of the web 2 into the lowered surface portions 27 and/or the through-going holes 35, the web 2 is protected from sticking by the steam film that is formed against the sleeve 15, which is an effect that heretofore has not been known. The main task of the imprinting elements 24 is, however, to structure the web 2 in accordance with the pattern on the mantle surface 14, whereby favorable effects are achieved as previously noted.

It will be recognized that the number of, the sizes, the materials, and the shapes of the elements and details making up the press, for instance of the roll body 7, the sleeve 15 and the imprinting elements 24, in general will be dependent on the particular requirements of the process for producing the particular type of paper desired. The press device 5 may thus comprise one of several different types of press devices 5, for instance a conventional press roll, an open or a closed shoe press roll, or any another suitable press roll. The outer diameter of the sleeve 15 generally will be at least about 1.0 meter. The sleeve 15 may be manufactured by sintering, casting, cold pressing, milling, welding, or combinations or such techniques.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A press for imprinting and drying a wet fibrous web, comprising:

a press device;

a rotatable, cylindrical roll body arranged to form a press nip with the press device;

an endless clothing arranged to run through the press nip in contact with the wet web; and a heating system for heating the wet web in the press nip, the heating system comprising:

a heatable sleeve encircling the roll body and in driven engagement therewith such that the sleeve passes through the nip along with the web and endless clothing, the sleeve having an external mantle surface that faces the web in the press nip; and at least one heating apparatus for heating the sleeve;

wherein the external mantle surface of the sleeve comprises a plurality of imprinting elements arranged in a pattern for imparting in the wet web a pattern imprint corresponding to that of the imprinting elements.

2. The press of claim 1, wherein the imprinting elements include recesses in the mantle surface that form relatively raised and lowered surface portions in a relief pattern, the raised surface portions being in pressing contact with the web, and wherein the imprinting elements are arranged in size and number such that the raised surface portions in pressing contact with the web make up between about 20 percent and about 50 percent of the mantle surface.

3. The press of claim 1, wherein at least one of the imprinting elements has a plan shape that is circular, elliptical, or polygonal.

4. The press of claim 1, wherein the imprinting elements include through holes formed through a thickness of the sleeve.

5. The press of claim 1, wherein the imprinting elements comprise continuous or intermittent lines of relatively raised and lowered surface portions that extend about the sleeve at an angle of about 10° to 80° relative to the direction of rotation of the sleeve.

6. The press of claim 5, wherein the lines of relatively raised and lowered surface portions comprise continuous grooves formed in the mantle surface spaced apart from one another.

7. The press of claim 5, wherein the lines of relatively raised and lowered surface portions comprise discrete spaced-apart regions of relatively raised and lowered surface portions.

8. The press of claim 1, wherein the imprinting elements comprise a plurality of parallel grooves formed in the mantle surface extending thereabout so as divide the mantle surface into alternately raised and lowered surface portions that in cross-section have a bottom surface and a top surface and two wall surfaces that extend from the bottom surface to the top surface.

9. The press of claim 8, wherein the grooves extend at an angle of about 10° to about 170° relative to the end face of the sleeve.

10. The press of claim 8, wherein a spacing distance is provided between adjacent individual grooves or between adjacent groups of grooves, and wherein the spacing distance is about 1 mm to about 5 mm, while each groove has a width of about 0.5 mm to about 2 mm and a depth of about 0.1 mm to about 2 mm.

11. The press of claim 1, wherein the imprinting elements comprise a first set of spaced parallel grooves formed in the mantle surface so as to extend from a first end of the sleeve to a second end thereof, and a second set of spaced parallel grooves formed in the mantle surface so as to extend from the second end to the first end, the two groups of grooves forming an angle of about 10° to about 170° with each other.

12. The press of claim 11, wherein the first and second groups of grooves form different angles relative to an end surface of the sleeve.

13. The press of claim 1, wherein the press device comprises a cylindrical press roll.

14. The press of claim 1, wherein the web is arranged to contact and be carried by an angular sector of the mantle surface having an angular extent of about 10° to about 300°.

15. The press of claim 1, wherein the heating apparatus is located about 30° to about 330° ahead of an inlet to the press nip as measured circumferentially about the sleeve.

16. The press of claim 1, wherein the roll body defines a first blow zone at which the web is detached from the sleeve and a second blow zone located downstream of the first blow zone for cleaning the sleeve.

17. The press of claim 1, wherein the clothing comprises a belt having recesses therein to receive liquid from the web and carry the liquid away from the web and out of the press nip and for imparting an imprinted pattern in the web.

18. The press of claim 1, wherein the heating apparatus comprises a burner that also causes combustion of fiber residues on the sleeve so as to clean the sleeve.

19. A press for imprinting and drying a wet fibrous web, comprising:

a press device;

a rotatable, cylindrical roll body arranged to form a press nip with the press device;

an endless clothing arranged to run through the press nip in contact with the wet web; and a heating system for heating the wet web in the press nip, the heating system comprising:

a heatable sleeve encircling the roll body and in driven engagement therewith such that the sleeve passes through the nip along with the web and endless clothing, the sleeve having an external mantle surface that faces the web in the press nip; and at least one heating apparatus for heating the sleeve;

wherein the external mantle surface of the sleeve comprises a plurality of imprinting elements arranged in a pattern for imparting in the wet web a pattern imprint corresponding to that of the imprinting elements, and wherein the sleeve is generally cylindrical and is mounted about the roll body in such a manner as to allow the sleeve to freely expand relative to the roll body upon heating and thermal expansion of the sleeve.

20. The press of claim 19, wherein the sleeve is substantially rigid.

21. The press of claim 20, wherein the sleeve fits closely about the roll body at room temperature and expands when heated by the heating apparatus so as to become loose about the roll body.

22. The press of claim 19, wherein the sleeve is flexible and deformable.

23. The press of claim 19, wherein the sleeve is impermeable.

24. The press of claim 19, wherein the sleeve is permeable.

25. A press for imprinting and drying a wet fibrous web, comprising:

a press device;

a rotatable, cylindrical roll body arranged to form a press nip with the press device;

an endless clothing arranged to run through the press nip in contact with the wet web; and a heating system for heating the wet web in the press nip, the heating system comprising:

a heatable sleeve encircling the roll body and in driven engagement therewith such that the sleeve passes through the nip along with the web and endless clothing, the sleeve having an external mantle surface that faces the web in the press nip; and at least one heating apparatus for heating the sleeve;

wherein the external mantle surface of the sleeve comprises a plurality of imprinting elements arranged in a pattern for imparting in the wet web a pattern imprint corresponding to that of the imprinting elements, and wherein the sleeve comprises a metallic fabric formed into a cylinder shape.

26. A press for imprinting and drying a wet fibrous web, comprising:

a press device;

a rotatable, cylindrical roll body arranged to form a press nip with the press device;

an endless clothing arranged to run through the press nip in contact with the wet web; and a heating system for heating the wet web in the press nip, the heating system comprising:

a heatable sleeve encircling the roll body and in driven engagement therewith such that the sleeve passes through the nip along with the web and endless clothing, the sleeve having an external mantle surface that faces the web in the press nip; and at least one heating apparatus for heating the sleeve;

wherein the external mantle surface of the sleeve comprises a plurality of imprinting elements arranged in a pattern for imparting in the wet web a pattern imprint corresponding to that of the imprinting elements, and wherein the sleeve is formed from a plurality of lengths of metal plate joined end-to-end to form a cylinder shape.

27. A press for imprinting and drying a wet fibrous web, comprising:

a press device;

a rotatable, cylindrical roll body arranged to form a press nip with the press device;

an endless clothing arranged to run through the press nip in contact with the wet web; and a heating system for heating the wet web in the press nip, the heating system comprising:

a heatable sleeve encircling the roll body and in driven engagement therewith such that the sleeve passes through the nip along with the web and endless clothing, the sleeve having an external mantle surface that faces the web in the press nip; and at least one heating apparatus for heating the sleeve;

wherein the external mantle surface of the sleeve comprises a plurality of imprinting elements arranged in a pattern for imparting in the wet web a pattern imprint corresponding to that of the imprinting elements, and wherein the press device comprises a shoe press roll having a press shoe defining a concave surface that forms an extended nip with the sleeve, the shoe press roll further including a flexible jacket arranged to run through the press nip in sliding contact with the concave surface.

* * * * *